United States Patent [19]

Normandin

[11] 3,954,358

[45] May 4, 1976

[54] COMPRESSOR

[76] Inventor: Michel Normandin, 1328 Nelles, Ste-Foy, Quebec, Canada

[22] Filed: Aug. 16, 1974

[21] Appl. No.: 498,215

[52] U.S. Cl. ..... 418/151; 418/255

[51] Int. Cl.[2] ..... F01C 21/00; F01C 1/00; F04C 17/00; F04C 29/00

[58] Field of Search ..... 418/150, 151, 254, 255

[56] References Cited

UNITED STATES PATENTS

| | | | |
|---|---|---|---|
| 1,619,429 | 3/1927 | Maillefer | 418/151 |
| 2,046,873 | 7/1936 | Garrison | 418/255 |
| 2,165,963 | 7/1939 | Curtis | 418/255 |
| 2,195,968 | 4/1940 | Meador | 418/255 |
| 2,260,888 | 10/1941 | Davis | 418/255 |
| 2,314,056 | 3/1943 | Sobek | 418/151 |
| 2,372,076 | 3/1945 | Fowler | 418/255 |

FOREIGN PATENTS OR APPLICATIONS

| | | | |
|---|---|---|---|
| 858 | 1904 | United Kingdom | 418/151 |
| 413,824 | 3/1946 | Italy | 418/151 |
| 836,423 | 10/1938 | France | 418/151 |

*Primary Examiner*—John J. Vrablik
*Attorney, Agent, or Firm*—Cushman, Darby & Cushman

[57] ABSTRACT

The disclosure herein describes a compressor that includes: a housing with an interior profile of a first order configuration with constant diametrical chord, a rotor including a series of arc-shaped segments disposed in circular alignment in the housing and equally spaced to define therebetween a series of elongated radial openings, a system of partially unbalanced vanes slidably mounted in the openings and bearing at each extremity thereof against the interior profile of the housing. Each vane defines in the housing chambers of variable volume depending on the relative rotational position of each segment with respect to the housing profile. Intake means are provided for introducing a compressible fluid in one of the chamber while exhaust means are provided for discharging the compressed fluid from an other of the chambers.

13 Claims, 10 Drawing Figures

COMPRESSOR

FIELD OF THE INVENTION

The present invention relates to vane-type rotary fluid displacing machines, such as pumps and compressors. More particularly, the invention pertains to such a machine for compressing a fluid from a low pressure to a high pressure, the compressed fluid being either stored in a tank or used directly in a given process.

DEFINITIONS

Certain terms are used in the following disclosure and claims and a definition thereof is now given for a complete understanding thereof:

"generating circle": a circle around which a configuration is established;

"symmetrical configuration of even order": a configuration that reproduces a given pattern an even number of times around a generating circle;

"symmetrical configuration of odd order": a configuration that reproduces a given pattern an odd number of times around a generating circle;

"symmetrical configuration of odd order with constant diametrical chord": a symmetrical configuration of odd order in which the length of the chord going through the generating circle is a constant;

"totally unbalanced vane": a single vane that moves around any configuration and remains in line with the chord going through the center of the generating circle; and "partially unbalanced vanes": a double vane system that moves around a configuration of odd order with constant diametrical chord; it is equivalent to two diametrically opposed single vanes or blades tied together by rigid rods along the chord.

BACKGROUND OF THE INVENTION

A symmetrical configuration of second order system is already in use for small high pressure pumps; it has been observed, however, that the power required to move the totally unbalanced vanes and the amount of heat losses due to the friction of the vanes on the interior profile of the casing, or stator, are such that the system has a low efficiency.

Several fluid displacing machines are known where partially unbalanced vanes are used, some of which may be found described in U.S. Pat. No. 1,046,791 issued Dec. 10, 1912, U.S. Pat. No. 1,977,780 issued Oct. 23, 1934, U.S. Pat. No. 2,452,471 issued Oct. 26, 1948 and U.S. Pat. No. 3,642,390 issued Feb. 15, 1972.

These systems use a third order configuration or a trilobic housing around a circular rotor. Although the centrifugal action on the vanes and the heat losses on the housing may be reduced, the power required to accelerate the double vanes a number of times around the generating circle is such that it precludes the utilization of any of these systems.

Monolobic rotary air compressors which have a housing with an interior profile of a first order configuration are known but most of them make use of totally unbalanced vanes (single vanes) to separate the various compression chambers. These systems require elaborate lubrication sub-systems to reduce the friction on the housing and to ensure adequate sealing between the chambers. Indeed, these compressors require, for proper operation, large quantities of oil to reduce the effect of the pressure of the totally unbalanced vanes on the housing and further require an oil-recuperating sub-system to clean the compressed air of oil vapor and droplets; such sub-system is expensive and introduces substantial pressure losses that lowers the total efficiency of the system.

OBJECTS

A principle object of this invention is the provision of new improvements in the construction of vane-type rotary fluid displacing machines.

A further object of this invention is the provision of a new rotary compressor which has a dependable operation with simple maintenance and with a small number of moving parts.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and the scope of the invention will become apparent to those skilled in the art from this detailed description.

SUMMARY OF THE INVENTION

These objects are accomplished according to the present invention by the provision in a vane-type rotary fluid displacing machine of a housing having an interior profile of a first order configuration with constant diametrical chord, a rotor rotatably mounted in the housing and including a series of arc-shaped segments disposed in circular alignment in the housing and equally spaced to define therebetween a series of elongated radial openings, a system of at least two partially unbalanced vanes slidably mounted in the openings and bearing at each extremity thereof against the interior profile whereby the constant diametrical chord is equal to the length of the vanes, each vane defining in the housing, between the interior profile and the segments, chambers of variable volume depending on the relative rotational position of each segment with respect to the housing profile.

In the preferred form of the invention, the fluid displacing machine is used as a compressor and the interior profile of the housing further includes: two opposite constant radius sections having central angles at least equal to $\pi/N$, where N is the number of vanes; intake means for introducing a compressible fluid in one of the chambers, and exhaust means for discharging the compressed fluid from an other of the chambers.

In the preferred form, the partially unbalanced vanes are considerably balanced with the addition of weight means acting directly on the vanes to gradually counteract the effect of the centrifugal and inertial forces as the latter increase. The vane pressure on the housing is thus significantly reduced with corresponding higher efficiency and elimination of the oil recuperating sub-system.

DESCRIPTION OF PREFERRED EMBODIMENTS

Referring in detail to the drawings, a preferred embodiment of a vane type rotary fluid displacing machine in accordance with the invention is illustrated in the form of a compressor. However, it should be understood that the person skilled in the art, having knowledge of the present invention will have no difficulty in modifying the structure of the machine illustrated to that of a pump.

The compressor 10 includes an outer stationary housing 12, or stator, and a central rotary portion 14, or rotor.

The housing has an interior profile 16 which is monolobic, that is of a first order configuration with constant diametrical chord. Profile 16 has a first section *a–b* which is of constant radius and a second section *b–c–d* of increasing radius; thereafter a third section *d–e* of constant radius is followed by a section *e–f–a* of decreasing radius. The angles of the opposed constant radius sections *a–b* and *d–e* are equal to $\pi$/N, where N is the number of vanes.

Figure 2:
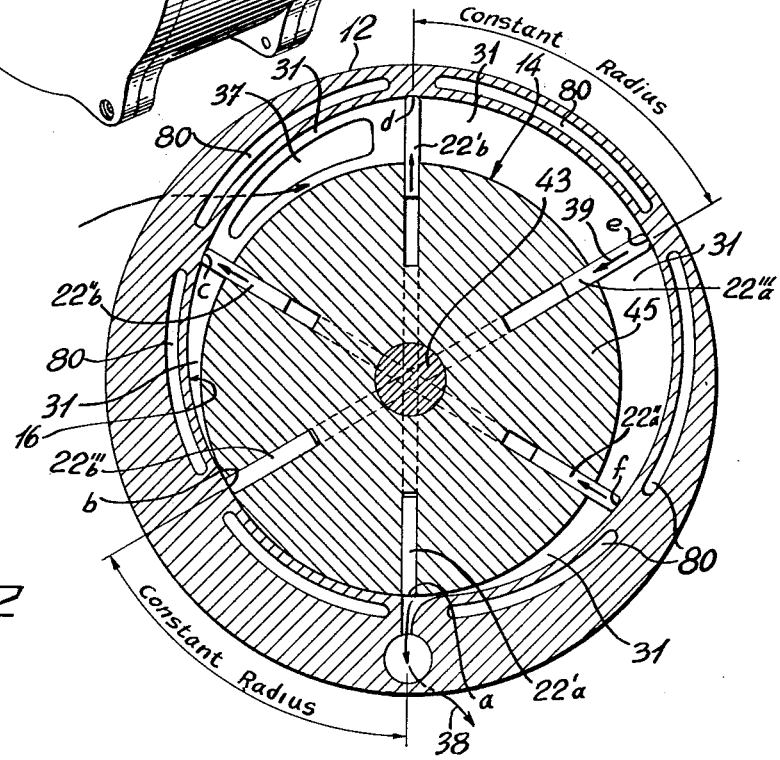
FIG. 2 is a schematic transverse cross-section of the machine showing the housing, the rotor and the vanes.
Figure 3:
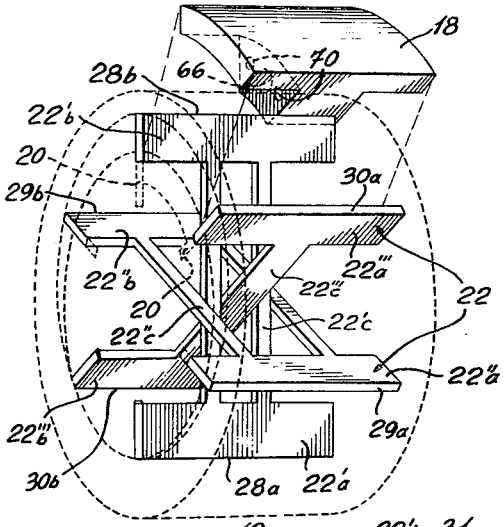
FIG. 3 is a perspective exploded view showing the interfitted vanes with one arc-shaped segment.
Figure 4:
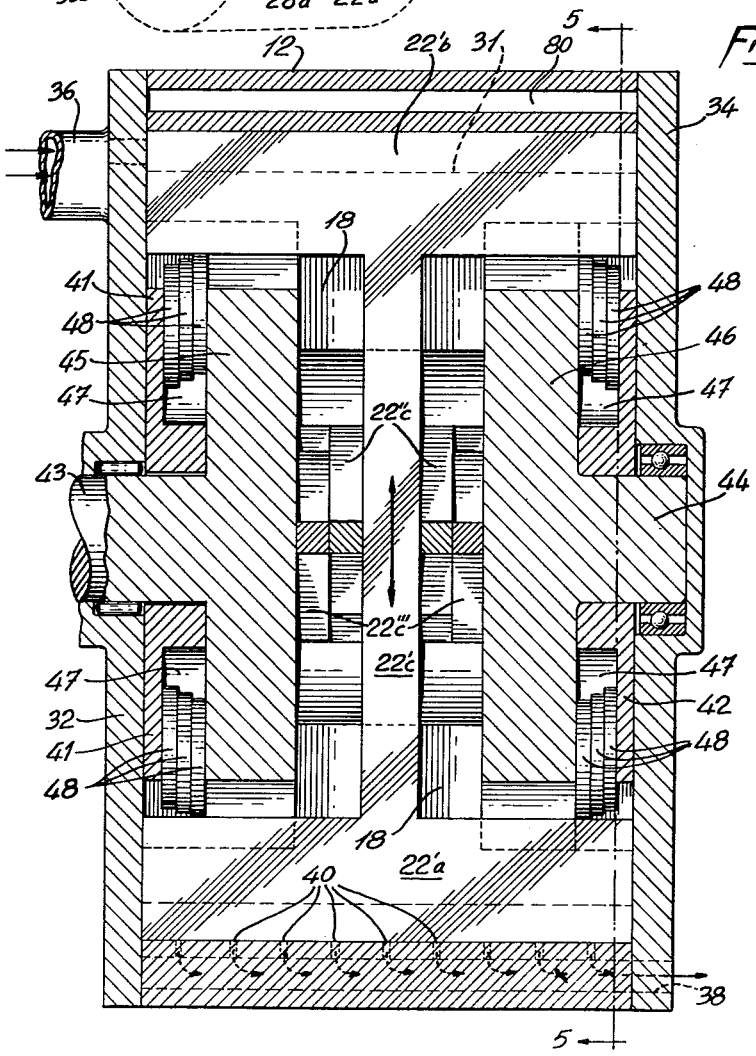
FIG. 4 is a longitudinal cross-section of the machine showing the vanes in position of equilibrium.

The rotor 14 is rotatably mounted in the housing and first includes a series of arc-shaped segments 18 (see FIG. 3) disposed in circular alignment in the housing. The segments are equally spaced from one another to define therebetween a series of elongated radial openings 20. Slidably mounted in these openings is a set of at least two partially unbalanced vanes 22, each vane having a length equal to the diametrical chord of the interior profile 16 of the housing. In the preferred embodiment, there are shown three partially unbalanced vanes 22', 22'', 22''' built in such a way that they interfit one another; they are either built from a single plate of metal or with two separate blades, such as blades 22'a–22'b, 22''a–22''b, 22'''a–22'''b joined together by appropriate rigid ties 22'c, 22''c, 22'''c, respectively. Each opposite extremity 28a–28b, 29a–29b, 30a–30b of the vanes bears against the interior profile 16 of the housing and thereby defines, between the interior profile 16 and the outer faces of the segments 18, chambers 31 of variable volume depending on the relative rotational position of each segment with respect to the housing profile; in FIG. 2, chamber 31 between points *a* and *b* is theorically zero.

Two end plates 32 and 34 close the opposite ends of the housing 12. An intake inlet 36 is provided in the end plate 32 for allowing the introduction of a compressible fluid in a passageway 37 to one of the chamber, such as chamber 31 between points *c* and *d*. Similarly, an exhaust outlet 38 may be provided in plate 34 for discharging the compressed fluid from an other of the chambers 31, for example between points *f* and *a*. The exhaust outlet means may consist, for example, of a series of holes provided in the housing 12.

In the case of a pump for an incompressible fluid, the intake will be located in one of the end plates between points *b* and *d* of the housing and the exhaust will be located between points *e* and *a* of the housing on the same end plate or on the opposite one.

In sectors *a–b* and *d–e*, the forces action on the vanes are the ones produced by the centrifugal acceleration and the housing reaction. In sectors *b–c* and *e–f*, the radial displacement of the vanes produces an additional radial force in the general direction e toward b, as indicated by arrow 39. A similar force is produced in sectors *c–d* and *f–a;* however, in this case, in the general direction *c* toward *f*.

The transition curve *b–c–d* may be a doubly inverted parabolic curve tangent with both circular arcs at points *b* and *d* and with point of inflection at *c*. In the case of a doubly inverted parabolic curve, there are abrupt changes in radial acceleration at points *b*, *c* and *d*.

In the form of the preferred embodiment, the partially unbalanced vanes 22 of the present system are greatly balanced with the addition of a counterweight action on the double vanes; this significantly reduces the vane pressure on the housing and provides high efficiency and elimination of oil-recuperating sub-systems.

Referring to FIGS. 4–9 of the drawings, this counterweight action is accomplished by means of two circular rings 41 and 42 mounted adjacent the end plates 32 and 34, respectively. These rings are mounted co-axially to input and output shafts 43 and 44, respectively, which in turn terminate in the housing with circular plates 45 and 46, respectively. These plates are disposed between the tie rods 22'c, 22''c, 22'''c of the double vanes and the two circular rings 41 and 42. A series of cavities 47 are provided in each circular ring to receive a series of disc-shaped counterweights 48 (there being shown). The outer radial wall of each cavity is stepped, the number of steps corresponding to the number of discs in the cavity.

Figure 5:
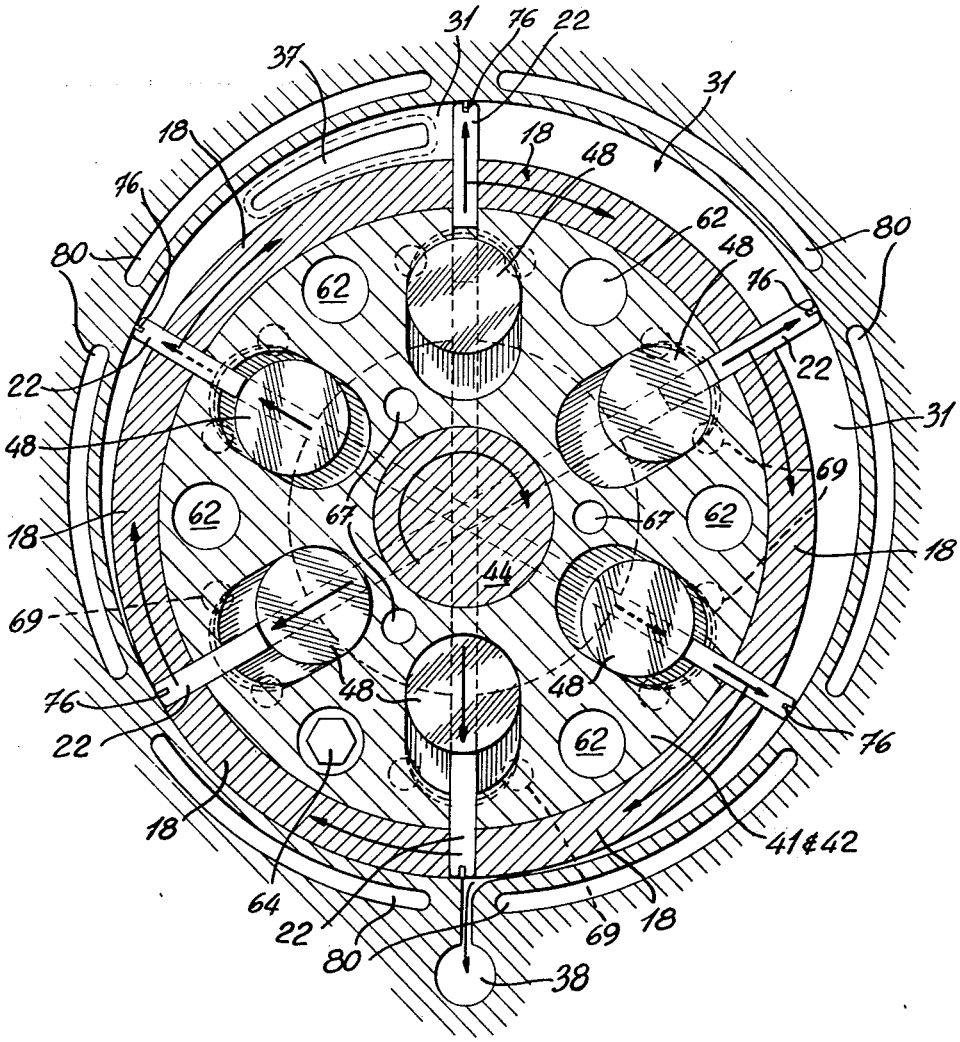
FIG. 5 is a transverse cross-section taken along lines 5—5 of FIG. 4.
Figures 6, 7, 8, 9:
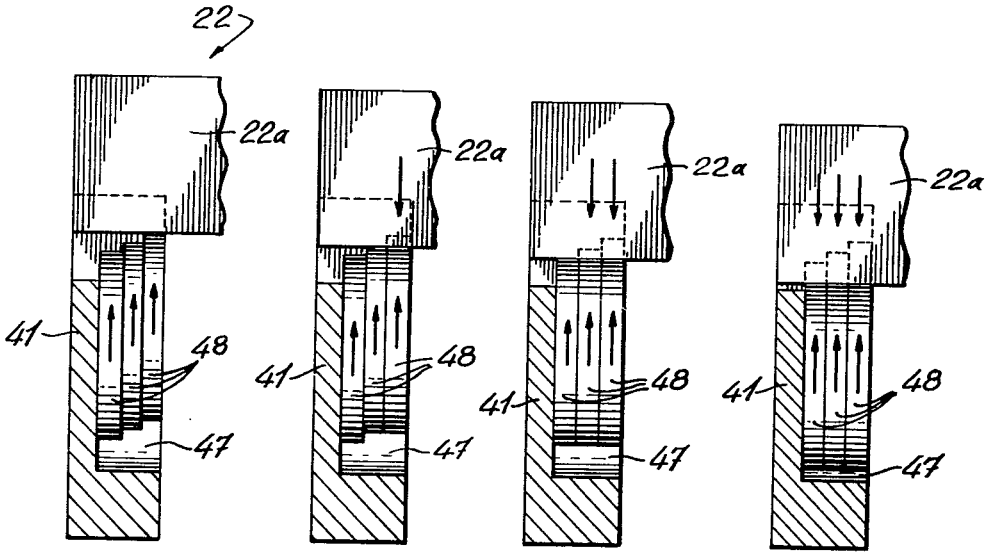
FIGS. 6 to 9 illustrate the gradual action of counterweight discs on the vanes.

A series of fastening means, one of which is shown as 64 in FIG. 5, secure the segments 18 to the plates 45 and 46, suitable openings 62 are provided in the circular discs 41 and 42 to allow passage of these fastening means in their proper position. Holes 67 are shown in disc 42 to receive fastening means therein for securing the circular discs 41 and 42 to the plates 45 and 46, respectively. Also, holes 69 and 70 are respectively provided in members 45–46 and 18 to receive guide pins (not shown) therein.

The action of the counterweights on the double vanes will now be described with reference to FIGS. 5 to 9. In its rotational movement, the rotor produces a radial alternative movement on the double vanes whose amplitude is equal to the difference between the maximum and the minimum heights of the chamber. When the double vane moves away from its neutral position, the vectorial sum of the centrifugal forces acting on the two blades is increased up to a maximum value and the resultant is in the direction defined by the blade farther from the center. This vectorial sum is drastically reduced with the addition of the circular discs which come successively in contact with the blade and act as linearly added counterweights.

In FIGS. 6–9, a downward movement of the vane 22 from its neutral position (FIG. 6) increases the centrifugal action on the blade 22a by the addition of the counterweights 48 whereas the effective mass of the opposite blade (not shown) decreases as the discs are successively refrained from pressing downwards on this opposite blade.

The inertia force produced on double vane by the radial movement of the vane system must be taken into account in the determination of the counterweights required to minimize blade pressure on the housing.

Instead of modifying the effective mass of the blade very rapidly and in a very short distance around the neutral position, counterweights may be added (or substracted) along the entire movement of the vane. Increasing the number of discs will reduce the shock between the discs and the blade.

Figure 10:
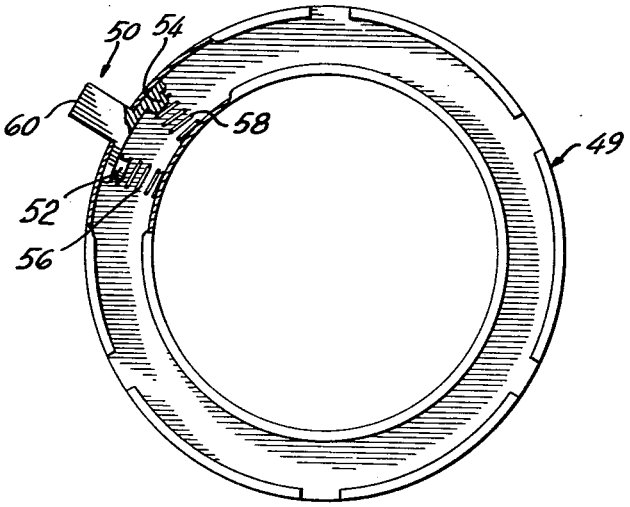
FIG. 10 shows an alternative form of counterweight means acting on the vanes.

Similar counterweight action may also be obtained if the rings 41 and 42 are substituted by pressure rings 49, such as illustrated in FIG. 10. A series of lugs 50 are mounted in the ring 49 and include two projections 52 and 54 which receive the ends of two springs 56 and 58, respectively; the opposite ends of the springs come into contact with the inner circumferential wall of the ring 49. The outer face 60 of each lug comes in contact with corresponding blades of the double vanes in the same way as the counterweight discs described above. The spring constant of the springs required to minimize the vane pressure on the housing is a function of the rotational speed of the rotor.

Figure 1:
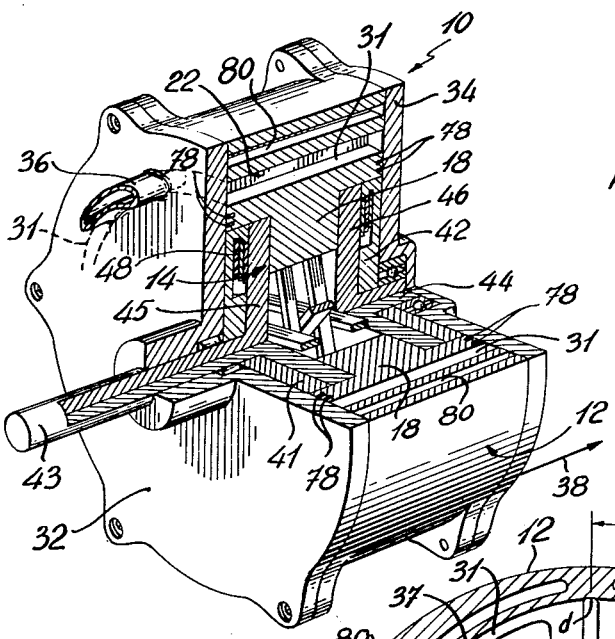
FIG. 1 is a perspective, partly cut away, view of one embodiment of a fluid displacing machine in accordance with the present invention.

Suitable sealing means are provided to prevent leakage from one chamber to another and include, for example, vane tips 76 provided at each extremity of the double vanes. Other sealing means will be provided on the sidewalls of the arc-shaped segments, such as sealing rings 78 (FIG. 1).

Although not illustrated in the drawings, lubrication, if required, may consist, for example, of oil being injected at a very slow rate through the rotor shaft. The centrifugal action will distribute this oil on both sides of the double vanes, on the vane tips and on the housing through very small weep holes in the vanes.

Depending on operational conditions, housing cooling may be achieved by an adequate water jacket 80 (FIG. 4) operating in conjunction with an heat-dissipating sub-system, or by a suitable air cooling sub-system.

What I claim is:

1. In a vane-type rotary fluid displacing machine a housing having an interior profile of a first order of configuration with constant diametrical chord, a rotor rotatably mounted in said housing and including a series of arc-shaped segments disposed in circular alignment in said housing and spaced to define therebetween a series of elongated radial openings, a symmetrical system of unbalanced vanes slidably mounted in said openings and bearing at each extremity against said interior profile, said system including n vanes wherein n is an integer greater than 1, whereby said constant diametrical chord is equal to the length of said vanes, each of said vanes including a pair of blades disposed at 180° with respect to each other, each said vane defining in said housing, between said interior profile and said segments, chambers of variable volume depending on the relative rotational position of each segment with respect to said housing profile, and means mounted at opposite ends of said rotor associated with each blade of each individual vane and in line therewith for balancing the effect of centrifugal and inertial forces acting on said vanes.

2. In a machine as recited in claim 1, wherein *n*, the number of vanes, is an integer greater than two.

3. In a machine as defined in claim 1, wherein said means for balancing include circumferentially spaced groups of discs acting successively directly on one blade of said vanes as the centrifugal and inertial forces increase on the opposite blade of said vanes.

4. In a machine as defined in claim 1, wherein said means include circumferentially spaced spring biassed lugs acting on said vanes.

5. A vane-type rotary fluid displacing machine comprising a housing having an interior profile of a first order of configuration with constant diametrical chord, a rotor rotatably mounted in said housing and including a series of arc-shaped segments disposed in circular alignment in said housing and equally spaced to define therebetween a series of elongated radial openings, a symmetrical system of n partially unbalanced vanes slidably mounted in said openings and bearing at each extremity against said interior profile, where *n* is an integer greater than 1, whereby said constant diametrical chord is equal to the length of said vanes, each said vane defining in said housing, between said interior profile and said segments, chambers of variable volume depending on the relative rotational position of each segment with respect to said housing profile, each of said vanes including a pair of blades disposed at 180° with respect to each other and interconnected with ties, said ties being shaped to interfit each other to thereby prevent interfering with each other when said vanes slide in said openings of said rotor, balancing means mounted at opposite ends of said rotor associated with each blade of each individual vane and in line therewith for balancing the effect of the centrifugal and inertial forces acting on said vanes, intake means for introducing a compressible fluid in one of said chambers, and exhaust means for discharging the compressed fluid from another of said chambers.

6. A machine as defined in claim 5, wherein said profile of said housing includes two opposite constant radius sections having a central angle with a value equal to $\pi/N$ or less, wherein N is the number of vanes.

7. A machine as recited in claim 5 wherein n, the number of vanes, is an integer greater than two.

8. A machine as defined in claim 5, wherein said balancing means include circumferentially spaced spring biassed lugs acting on said blades.

9. A machine as defined in claim 5, wherein each said extremity of said vanes includes sealing means for preventing leakage from one chamber to an adjacent chamber.

10. A machine as defined in claim 5, wherein said exhaust means include exhausting holes in said housing for the discharging of said compressed fluid, said holes being disposed at the shallow end of the inner space between said housing and said segments.

11. A machine as defined in claim 5, wherein said balancing means include a pair of circular rings, each ring being provided with radially spaced group of counterweights acting directly on said blades to minimize the effect of the centrifugal and inertial forces.

12. A machine as defined in claim 11, wherein said group of counterweights consist of a plurality of radially stepped discs.

13. A vane-type rotary fluid displacing machine comprising a housing having an interior profile of a first order of configuration with constant diametrical chord, a rotor rotatably mounted in said housing and including a series of arc-shaped segments disposed in circular alignment in said housing and equally spaced to define therebetween a series of elongated radial openings, a symmetrical system of *n* partially unbalanced vanes slidably mounted in said openings and bearing at each extremity against said interior profile, where *n* is an integer greater than 2, whereby said constant diametrical chord is equal to the length of said vanes, each said vane defining in said housing, between said interior profile and said segments, chambers of variable volume depending on the relative rotational position of each segment with respect to said housing profile, each of said vanes including a pair of blades disposed at 180° with respect to each other and interconnected with ties, said ties being shaped to interfit each other to thereby prevent interfering with each other when said vanes slide in said openings of said rotor, balancing means mounted at opposite ends of said rotor associated with each blade of each individual vane and in line therewith for balancing the effect of the centrifugal and inertial forces acting on said vanes, intake means for introducing a compressible fluid in one of said chambers, and exhaust means for discharging the compressed fluid from another of said chambers.

* * * * *